US005511772A

United States Patent [19]

Ganz et al.

[11] Patent Number: 5,511,772

[45] Date of Patent: Apr. 30, 1996

[54] OSCILLATING ROTARY HOPPER

[76] Inventors: Robert H. Ganz, Saddle River, N.J.; Loretta R. Ganz, executrix; Robert S. Marcus, executor, both of No. 8, Ridgecrest Rd., Saddle River, N.J. 07458

[21] Appl. No.: 296,188

[22] Filed: Aug. 25, 1994

[51] Int. Cl.[6] ..... B65H 5/08

[52] U.S. Cl. ..... 271/12; 271/95; 271/108; 414/797.8

[58] Field of Search ..... 271/4, 5, 6, 11, 271/12, 14, 94, 95, 102, 31.1; 414/796.9, 797, 797.1, 797.8

[56] References Cited

U.S. PATENT DOCUMENTS

| | | | |
|---|---|---|---|
| 3,937,458 | 2/1976 | Langer | 271/95 |
| 4,482,145 | 11/1984 | Feldkämper et al. | 271/95 |
| 4,537,208 | 8/1985 | Kuhl | 271/5 |
| 4,605,393 | 8/1986 | Krieger et al. | 271/95 |
| 5,054,761 | 10/1991 | Dietrich et al. | 271/95 |
| 5,061,231 | 10/1991 | Dietrich et al. | 271/95 |

FOREIGN PATENT DOCUMENTS

| | | | |
|---|---|---|---|
| 3028494 | 2/1982 | Germany | 271/11 |

*Primary Examiner*—H. Grant Skaggs
*Attorney, Agent, or Firm*—Charles E. Brown; William H. Holt

[57] ABSTRACT

This relates to apparatus for transferring flat members such as cartons from a supplly to an applying conveyor chain and the like wherein the supply is disposed above the conveyor and at an angle thereto. The apparatus is in the form of a rotary hopper that is also mounted for oscillatory movement towards and away from the supply and also parallel to the conveyor wherein when a member receiving carrier of the hopper is aligned with a member, the carrier is moved to pick up the member while the carrier presenting a member to the conveyor is advanced at substantially the same rate as the conveyor. The carriers are preferably in the form of suction cups which are valve actuated as the hopper rotates.

8 Claims, 4 Drawing Sheets

OSCILLATING ROTARY HOPPER

This invention relates in general to new and useful improvements in the feeding of blanks and cartons, and more particularly to a hopper for feeding cartons from a carton supply or magazine to a carton applying conveyor.

GENERAL DISCUSSION OF INVENTION

In accordance with this invention, there is provided a customary carton supply magazine presenting cartons in a generally upstanding position to be received by a hopper and to be presented by such hopper to a carton applying chain in continuous adjacent relation.

More particularly, there is provided a carton applying hopper which is mounted for rotary movement about a rotating shaft with the hopper including a plurality of sets of suction cups with each set of suction cups being adapted to be presented to a face of a carton for removing the carton from a carton supply, then rotating the carton about the axis of the hopper after which the carton is presented in timed sequence to a carton applying conveyor. The hopper rotating shaft is oscillated relative to a pivot shaft so as to urge suction cups aligned with the carton supply towards and away from a carton to be picked up while at the same time moving a carton to be transferred to the carton applying conveyor at substantially the same rate as the rate of movement of the carton applying conveyor for reception thereby.

A feature of the hopper is that for each set of suction cups there is a manifold mounted for rotation with the rotary shaft of the hopper and that the suction cups are mounted on the manifold in radiating relation by way of tubular supports which are removably connected to the manifolds to vary the circumferential movement of the suction cups in accordance with the size of the cartons whereby the hopper is readily adjustable to transfer cartons of different sizes.

Another feature of the hopper is the provision of supply valves primarily utilized to provide a vacuum within the manifold and to the suction cups with the supply valves being automatically actuated as the hopper rotates.

With the above and other objects in view that will hereinafter appear, the nature of the invention will be more clearly understood by reference to the following detailed description, the appended claims, and the several views illustrated in the accompanying drawings.

IN THE DRAWINGS

DESCRIPTION OF THE INVENTION

Figure 1:
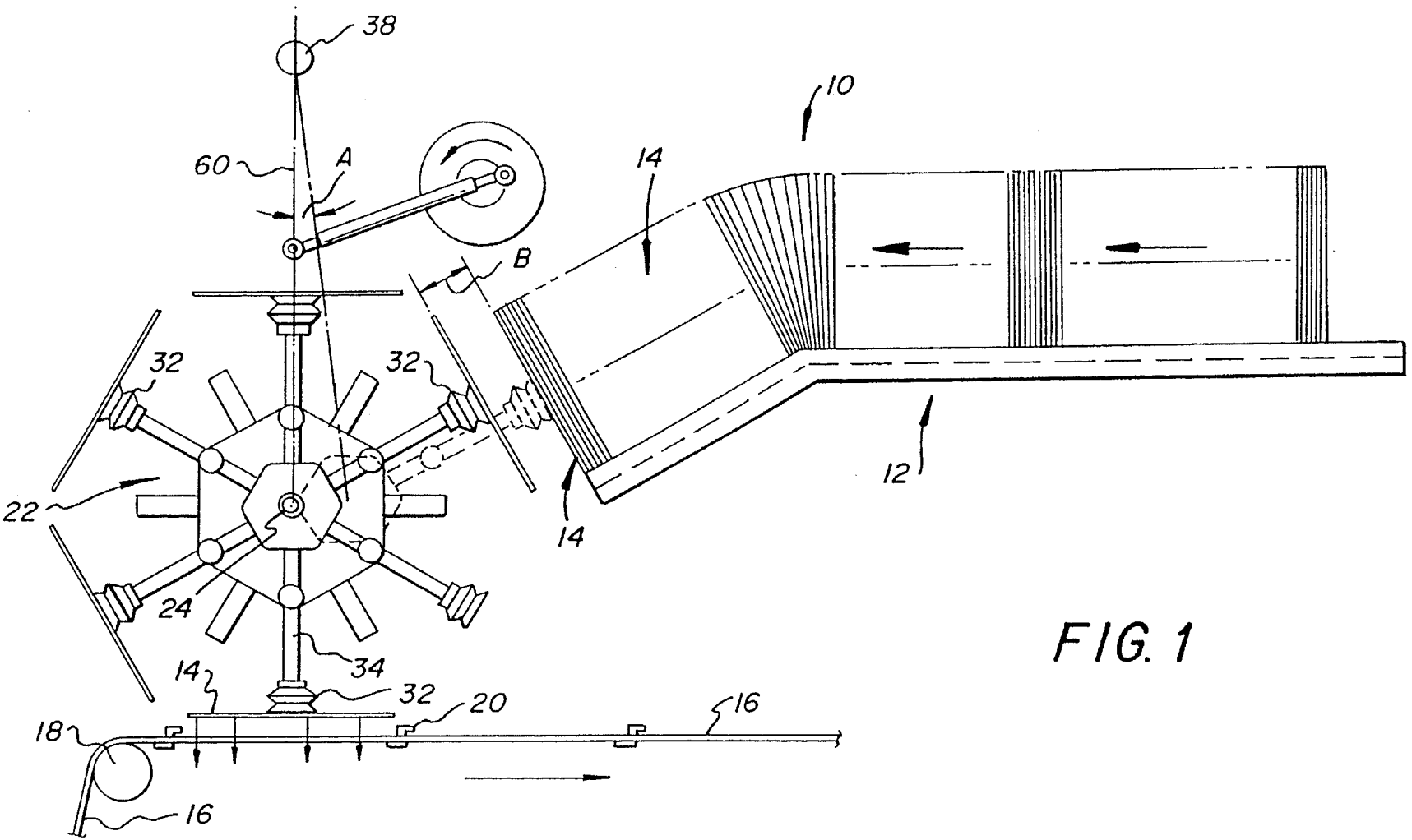
FIG. 1 is a side elevational view showing the relationship of the carton supply magazine and the carton applying conveyor and an oscillating rotary hopper in accordance with the invention for transferring cartons from the magazine to the carton applying conveyor.

Referring now to the drawings in detail, reference is first made to FIG. 1 wherein there are illustrated components of a conventional type of carton applying mechanism, generally identified by the numeral 10. The mechanism 10 includes a carton supplying magazine, generally identified by the numeral 12. The magazine 12 automatically advances cartons 14 and presents a foremost carton 14 in a generally upstanding position facing downwardly generally at an angle of 60°.

The mechanism also includes a chain conveyor 16 for applying cartons 14 to groups of containers in a manner not shown. A typical application of a carton 14 would be to a group of containers such as bottles and cans although the use of the cartons 14 for packaging is not so restricted.

It is to be understood that the conveyor 16 is in the form of a chain or transversely spaced chains which pass around sprockets or rollers 18, of which only one is shown. The conveyor chain 16 carries a plurality of uniformly spaced, transversely extending lugs 20 for engaging transferred cartons 14 to advance such cartons with the conveyor chain 16.

In order to transfer the cartons 14 from the carton supply magazine 12 to the conveyor chain 16, in accordance with this invention there is provided an oscillating rotary hopper generally identified by the numeral 22. The hopper 22 includes a rotary shaft 24 which has fixedly secured thereto a pair of hubs 26. Each hub 26 has extending therefrom in a radial direction a plurality of support members 28 with each pair of support members 28 supporting a manifold 30. In view of the 60° angle difference between the face of a carton 14 to be dispensed and the general plane of the carton applying conveyor chain 16, the most efficient number of manifolds 30 is six, as is shown both in FIG. 1 and FIG. 2.

Each manifold 30 carries one or more suction cups 32 for engaging the foremost carton 14 and transporting such carton from the magazine 12 to the conveyor chain 16 with the cartons being arranged circumferentially. Each suction cup 32 is carried by its manifold 30 in spaced relation by a tubular support 34 through which a vacuum may be drawn or air under pressure directed to the suction cups 32.

Figure 2:
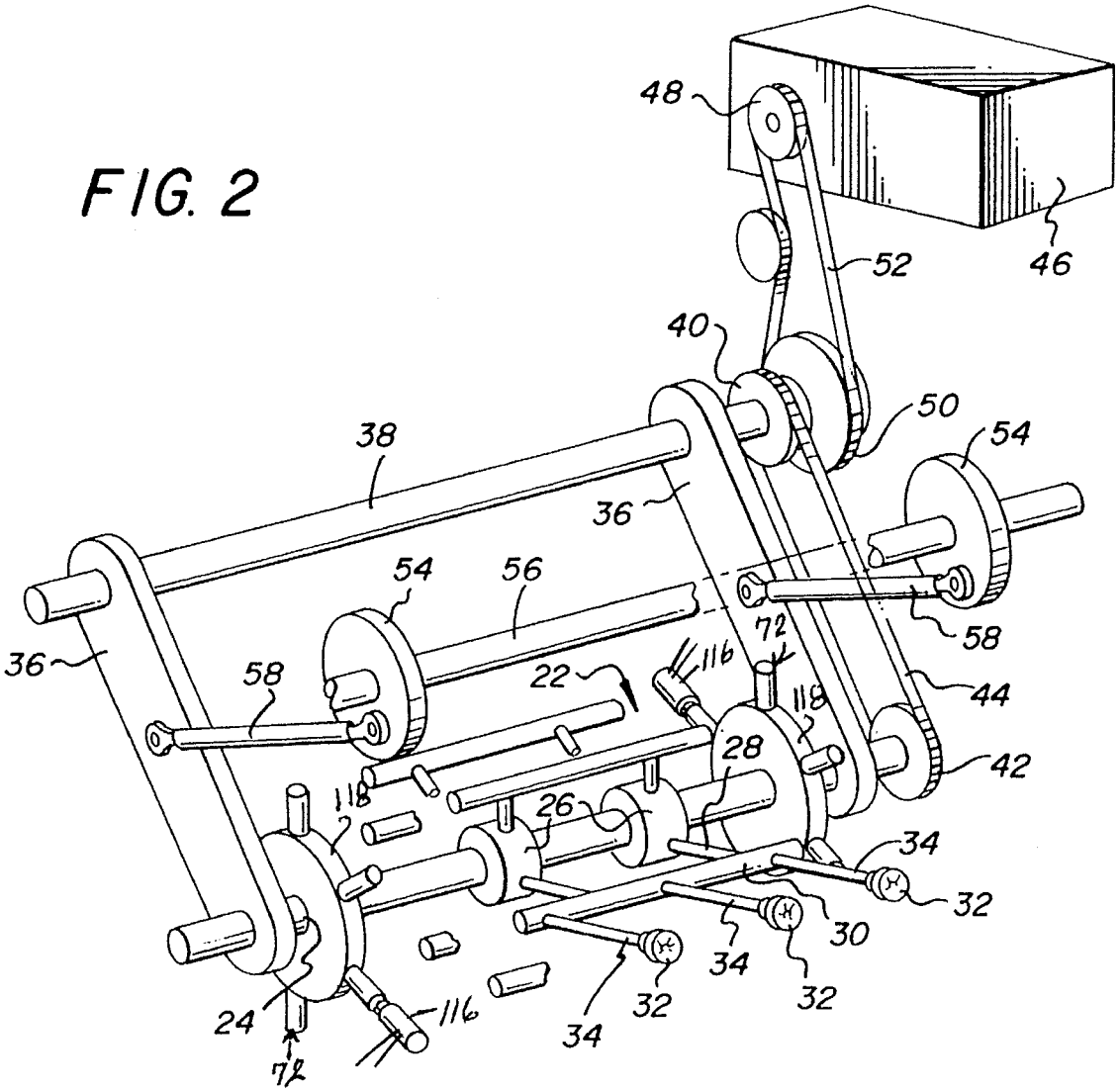
FIG. 2 is an exploded perspective view showing more specifically the details of the oscillating rotary hopper and the manner in which it is driven.

The manner in which a vacuum is drawn within the manifolds 30 or air under pressure is directed thereto is not shown in FIG. 2.

Referring once again to FIG. 1, it will be seen that the suction cups 32 pass along a circumferential path wherein the cartons 14 carried by the hopper 22 are in substantially touching relation. It is to be understood that this relationship should be maintained with all sizes of cartons 14. Thus, if the cartons 14 that are to be dispensed are of a greater height or width than the illustrated cartons 14, then the tubular supports 34 should be replaced by similar, but longer tubular supports and the rotary shaft 24 of the hopper 22 should be moved away from the magazine 12. On the other hand, should the height or width of the cartons 14 be reduced, then the length of the tubular supports 34 should in a like manner be reduced.

It is to be understood that the suction cups 32 are advanced in a step-by-step manner and those suction cups which face the end most carton 14 and are to pick up such carton 14, are moved radially towards the end most suction cup 32 to engage and pick up the suction cup and then returned to their original positions. In order to effect this movement, the rotary shaft 24, as is best shown in FIG. 2, is journaled for rotation in lower end portions of support arms 36 which have their upper ends pivotally mounted on a pivot shaft 38.

The pivot shaft 38 is rotatably journaled in the support arms 36 and carries an upper sprocket 40 which is connected to a lower sprocket 42 by way of a drive chain 44. The sprocket 42 serves to effect rotation of the rotary shaft 24.

In order that the rotary shaft 24 may be rotated in a step-by-step manner, there is provided a drive mechanism 46 which carries an output sprocket 48 connected to a larger sprocket 50 by way of a drive chain 52. The sprocket 50, in turn, is coupled to the pivot shaft 38 for rotating the same.

It is to be understood that the ratio of the diameters of the sprockets 48, 50 is 1 to 6 so that for each rotation of the sprocket 48, there is a 60° rotation of the rotary shaft 24 and thus a rotary advancement of each set of sprockets 32 one position.

At the time each set of suction cups 32 is in a position to pickup a foremost carton 14, the hopper 22 is pivoted about the pivot shaft 38 towards that foremost carton 14 as shown in dotted lines in FIG. 1. This is accomplished by a pair of cranks 54 mounted on a common crankshaft 56 and coupled to respective ones of the arms 36 by way of connecting rods 58. This results in the pivoting of the center line 60 between the pivot shaft 38 and rotary shaft 24 through an arc A, as shown in FIG. 1, to move the respective suction cups 32 a distance B preferably on the order of 2 inches.

At the same time the carton 14 carried by the suction cup 32 adjacent the conveyor chain 16 is advanced to the right at basically the same rate as the rate of movement of the conveyor chain 16 after which the carton carried by such suction cups is released and the suction cups move in the return direction free of the respective carton 14.

Figure 3:
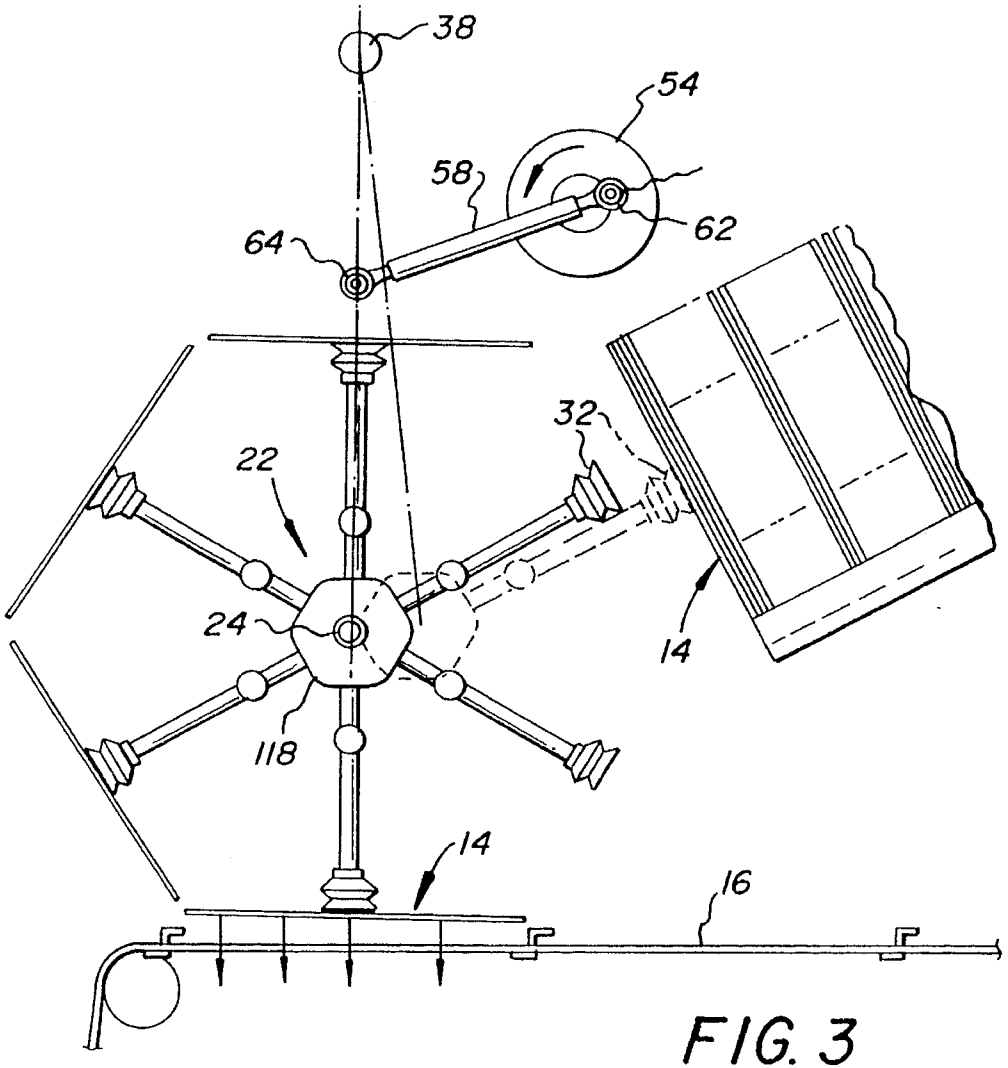
FIG. 3 is an side elevational view of the hopper showing more specifically the details thereof and the relationship to an enlarged carton supply magazine and the carton applying conveyor.

While the preferred drive means is by way of the cranks 54 and the connecting rods 58 as is best shown in FIG. 3, other suitable means may be provided for oscillating the rotary shaft 24 and the hopper 22 carried thereby. It is to be noted from FIG. 3 that one end of the connecting rod 58 is pivotally connected to the associated crank 54 by way of an adjustable rotary eye fitting 62 while the opposite end of the connecting rod 58 is pivotally connected to the respective support arm 36 by way of a similar rotary eye fitting 64.

Figure 4:
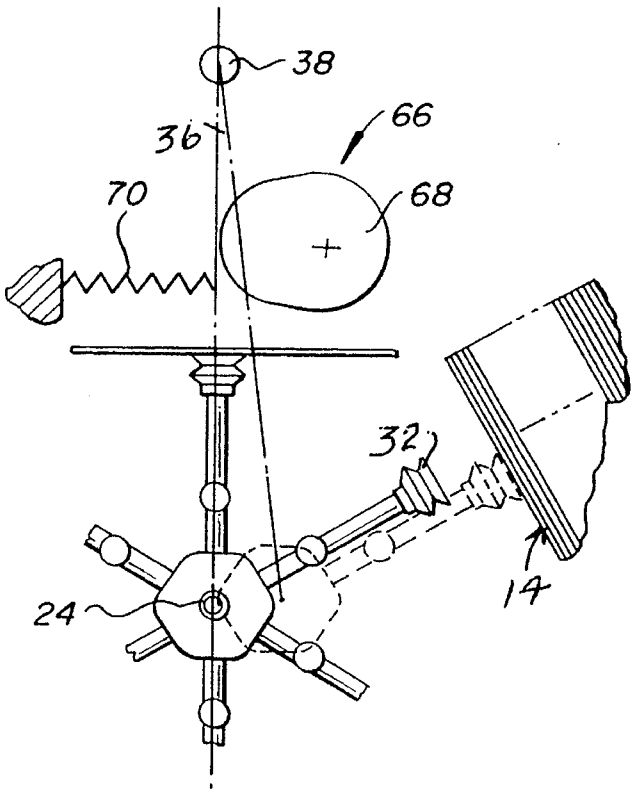
FIG. 4 is a fragmentary side elevational view of the hopper and magazine and shows a modified form of means for oscillating the hopper.

On the other hand, as shown in FIG. 4, oscillation of the rotary shaft 24 may be effected by different types of drive mechanisms including that shown in FIG. 4. This drive unit, which is identified by the numeral 66, includes a rotating cam 68 and a compression spring 70 engaging each support arm 36 or a fitting thereon in opposite directions.

It is desired that at the time suction cups 32 engage the cartons 14, that the suction cups 32 be under a vacuum and such vacuum be retained until the suction cups are ready to discharge the carton onto the conveyor chain 16, at which time the vacuum is replaced by air under compression and forcefully discharge the carton 14. This action is controlled by a valve unit such as that illustrated in FIGS. 5 and 6 and identified by the numeral 72. The valve unit 72 includes a tubular body 74 having a closed end 76 and an open end as at 78. The valve body 74 is provided with a pair of opposed internally threaded bores 80 and 82 into which there are removably threaded fittings 84. The fitting 84 associated with the bore 82 couples to the valve body 74 a supply line 86 which may be selectively connected to either a vacuum source or a compressed air source. On the other hand, the fitting 84 associated with the bore 80 connects a line 88 to the respective manifold.

A valve element 90 is slidably positioned within the bore of the valve body 74 by way of an O-ring 92 adjacent one end and a coupling sleeve 94 at the opposite end. The valve member 90 has a transverse bore 96 which is alignable with the bores 80, 82 and a body portion 98 which normally closes the bores 80, 82 against communication.

The valve 72 also includes an actuator 100 which includes an elongated stem 102 that is telescoped over a reduced end portion 104 of the valve member 90 and coupled thereto by the connecting member 94. The stem 102 also carries an O-ring 106.

Figure 5:
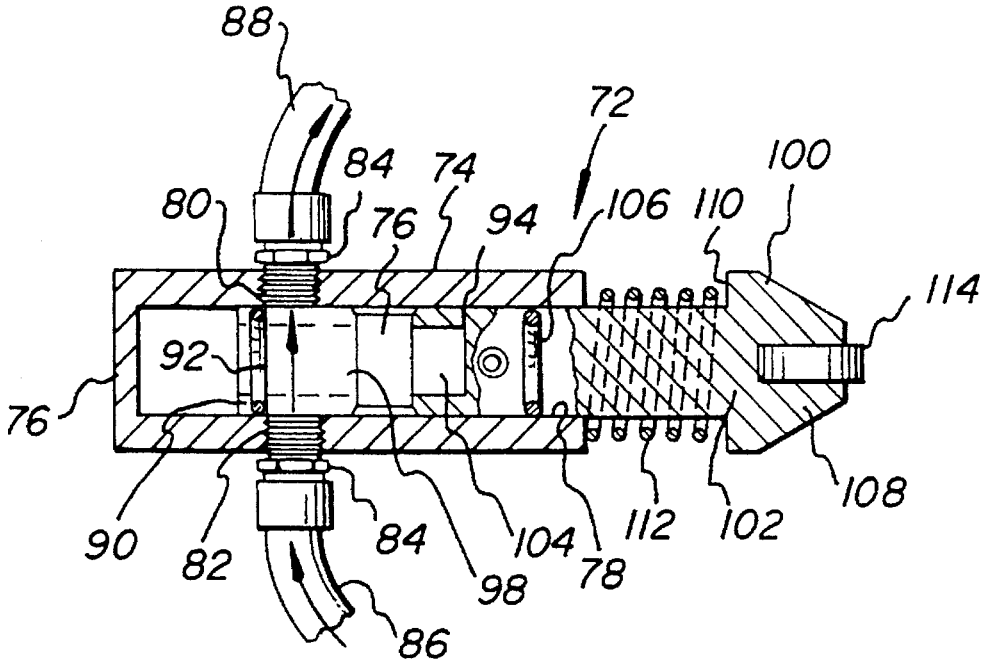
FIG. 5 is a side elevational view with parts broken away and shown in section of one of the supply valves in its closed position.

The actuator 100 is provided with an enlarged head 108 defining a shoulder 110 opposing the open end 78 of the valve body 74. A compression spring 112 extends between the end of the valve body 74 and the shoulder 110 to urge the valve body 92 in its closed position as illustrated in FIG. 5. The enlarged head 100 is provided with a roller 114 in the form of a cam follower.

Figure 6:
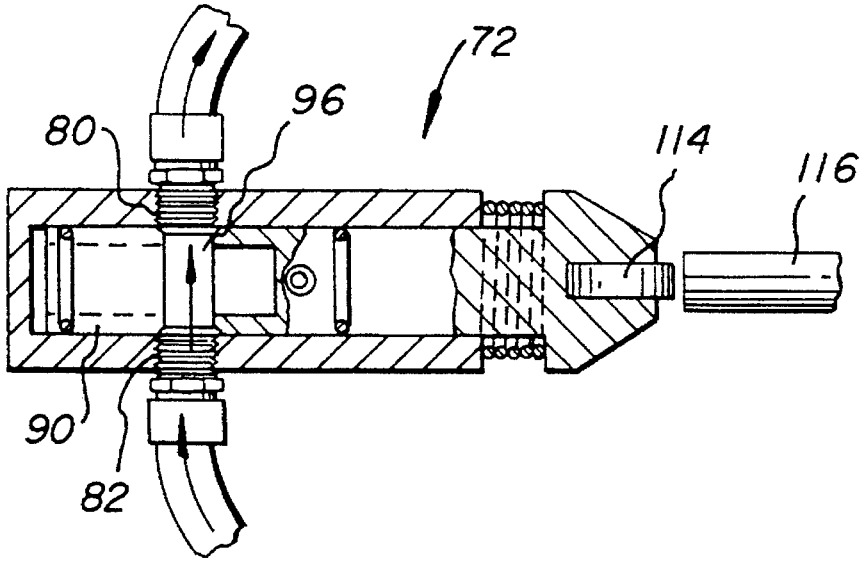
FIG. 6 is a view similar to FIG. 5 with the supply valve in its open position as effected by a cam relative to which the supply valve is rotated with other components of the hopper.

As is best shown in FIG. 6, the roller 114 engages a fixed cam 116 to move the valve member 90 to the left to align the bore 96 with the bores 80, 82 to cause pneumatic flow through the valve 72.

As is generally shown in FIGS. 1 and 3, the rotary shaft 24 carries hubs 118 for rotation therewith and each hub 118 carries in radiating relation one of the valve members 72 for each of the manifolds 30. Thus the valves 72 rotate with the rotary shaft 24 and its respective hub 118 for engagement with respective cams 116 which are fixed.

The manner in which the shaft 56 is driven and the conveyor chain 16 is advanced is not illustrated. However, it is to be understood that the two must be driven in unison and in timed relation to the location of the hopper 22.

The entire circumference of the hopper 22 is loaded with cartons and the hopper 22 is adjusted by changing the lengths of the tubes 34 as shown in FIG. 3.

Inasmuch as one is able to substantially alter the speed of the transferring carton to match the conveyor speed, this permits several different applications of the carton and also between the carton and product.

The valve which is used to isolate the vacuum to a specific set of vacuum cups, permits one to use one vacuum source only.

One of the big advantages of using step-by-step or intermittent motion drive on the carton transfer is that one can pick the carton up with several vacuum cups engaging the carton while the rotary movement is stationary and the vacuum cups push the entire line of cartons into the magazine 12 and removing the front most carton from the magazine.

Although the pivot for the hopper has been illustrated as being above the hopper, it may be below the hopper.

The adjustment of the eccentric will permit very deep withdrawal of the carton from the magazine which eliminates the requirement of having the carton strippers set very lightly. This provides maximum retention within the magazine. With this setting deep positioning of the stripper is also possible.

Although only one primary embodiment of the oscillating rotary hopper 22 has been illustrated, it is to be understood that not only may the hopper 22 be readily modified to receive different sizes of cartons 14, but also that various forms of drives may be utilized without departing from the scope and spirit of the invention as defined by the appended claims.

I claim:

1. An oscillating rotary hopper comprising a hopper rotary shaft, at least one member carrier carried by said hopper shaft for rotation with said hopper shaft, a pivot shaft, a conveyor and a member supply, at least one member in said member supply, at least one support arm pivotally mounted on said pivot shaft for oscillatory movement to move said member carrier back and forth forwards and away from said member supply and parallel to said conveyor, and said member carrier and said conveyor moving in the same direction and at the same speed when said member carrier is aligned with the conveyor.

2. A hopper according to claim 1 wherein there are a plurality of manifolds carried by said hopper rotary shaft, and said member carriers are carried by said manifolds in communication with said manifolds, and said member carriers are in the form of suction cups carried by tubular supports opening into said manifolds, said tubular supports are replaceable relative to said manifold for varying the spacing of said member carries from said hopper rotary shaft in accordance with the heights of members to be dispensed.

3. A hopper according to claim 2 wherein the height of said member times the number of manifolds is generally equal to, but less than the circumference of member carrier path of movement.

4. A hopper according to claim 3 wherein a change in member height can be compensated for by varying the length of said tubular supports.

5. A hopper (according to claim 13 wherein) comprising a hopper rotary shaft, at least one member carrier carried by said hopper shaft for rotation with said hopper shaft, a pivot shaft, a conveyor and a member supply, at least one support arm pivotally mounted on said pivot shaft for oscillatory movement to move said member carrier back and forth forwards and away from said member supply and parallel to said conveyor, a vacuum valve is associated with each member carrier for actuating a suction cup associated within a respective one of said member carriers, and said vacuum valves are carried by said rotary hopper shaft for rotation with said rotary hopper shaft and said vacuum valves are spring loaded shut (,).

6. A hopper according to claim 5 wherein said valves are controlled by cams.

7. A method of supplying cartons from a carton supply to a carton conveyor, said method comprising the steps of providing a hopper having a plurality of sets of suction cups, rotating said hopper to sequentially present said suction cups to said carton supply and then to said conveyors at regularly spaced intervals while oscillating said rotating hopper about a pivot shaft to move said suction cups towards and away from said carton supply to sequentially remove cartons from said carton supply, and utilizing the oscillation of said hopper to move cartons ready to be discharged in unison with conveyor, and moving said conveyor and each suction cup adjacent said conveyor at the same speed and in the same direction.

8. The method of claim 7 wherein said hopper is provided with manifolds supporting said suction cups by way of replaceable tubular supports for varying the path of movement of said suction cups in accordance with the size of cartons being dispensed.

* * * * *